United States Patent [19]

Khanamirian

[11] Patent Number: 4,973,277

[45] Date of Patent: Nov. 27, 1990

[54] SAFETY BELT HARNESS SYSTEM

[75] Inventor: Alexander Khanamirian, Miami, Fla.

[73] Assignee: Extrasport, Inc., Miami, Fla.

[21] Appl. No.: 392,415

[22] Filed: Aug. 11, 1989

[51] Int. Cl.[5] ..... B63C 9/08

[52] U.S. Cl. ..... 441/88; 182/3; 441/84; 441/106

[58] Field of Search ..... 182/3; 441/80, 88, 84, 441/85, 106, 108, 111–118, 125

[56] References Cited

U.S. PATENT DOCUMENTS

| | | | |
|---|---|---|---|
| 2,629,116 | 2/1953 | Frieder et al. | 441/116 |
| 3,449,778 | 6/1969 | Jones | 441/112 |
| 3,733,631 | 5/1973 | Cohn | 441/113 |
| 4,047,255 | 9/1977 | Kiefer | 114/39.2 |
| 4,545,773 | 10/1985 | Evert | 441/114 |
| 4,551,108 | 11/1985 | Bass | 441/116 |
| 4,567,961 | 2/1986 | Schoenfeld | 182/3 |
| 4,578,042 | 3/1986 | Evert | 441/117 |
| 4,725,253 | 2/1988 | Politte | 441/130 |
| 4,741,280 | 5/1988 | Mauderer et al. | 182/3 |

*Primary Examiner*—Sherman Basinger
*Assistant Examiner*—Edwin L. Swinehart
*Attorney, Agent, or Firm*—Fleit, Jacobson, Cohn, Price, Holman & Stern

[57] ABSTRACT

A life vest having a safety belt harness system. A safety belt of the safety belt harness system is threaded through loops on the life vest and is secured to the vest with a quick release, cam-type buckle. Removably attacheed to the back of the vest is a metal D-ring. The safety harness is threaded through the D-ring. A rope acting as a life line may be attached to the D-ring and then the other end of the rope attached to an object on shore, a helicopter, or to another person during rescue attempts. The rope connected to the D-ring of the life vest will be tensioned, for instance, when a rescuer descends from a helicopter, by the rope, during a rescue attempt. If the person wearing the life vest with the D-ring should get into trouble and need to immediately be detached from the rope to which they are connected, the person can unbuckle the cam-type buckle of the safety strap which, due to the tensioning of the rope connected to the D-ring, will pull the D-ring away from its VELCRO® connection on the rear of the vest. Since the safety belt has become unbuckled, the free end of the belt will unthread out of the D-ring and the D-ring will be pulled away from the vest leaving only the D-ring attached to the loose end of the rope.

12 Claims, 3 Drawing Sheets

SAFETY BELT HARNESS SYSTEM

FIELD OF THE INVENTION

This invention relates to a safety belt for a life vest. The safety belt is connected by a life line to a remote item and the safety belt is quickly releasable from the life vest.

BACKGROUND OF THE INVENTION

Life saving jackets have been used for many years both by those who attempt to rescue those in trouble and those already in danger. The more common type of life jackets include a zippered front for securing the life jacket about the upper torso of the body. Usually, adjustable straps conform the life jacket to the shape of the body and a thin securing strap is used to keep the life vest on the body of the wearer in the event that the zipper should open.

SUMMARY OF THE INVENTION

The present invention includes a life vest having in addition to a securing strap, a safety belt harness system. A safety belt of the safety belt harness system is threaded through loops on the life vest and is secured to the vest with a quick release, cam-type buckle. Removably attached to the back of the vest is a metal D-ring. The safety harness is threaded through the D-ring. A rope acting as a life line may be attached to the D-ring a helicopter, another object such as a "lost" kayak or boat, or to another person during rescue attempts.

The rope connected to the D-ring of the life vest will be tensioned, for instance, when a rescuer descends from a helicopter, by the rope, during a rescue attempt. If the person wearing the life vest with the D-ring should get into trouble and need to immediately be detached from the rope to which they are connected, the person can unbuckle the cam-type buckle of the safety strap which, due to the tensioning of the rope connected to the D-ring, will pull the D-ring away from its VELCRO-type connection on the rear of the vest. Since the safety belt has become unbuckled, the free end of the belt will unthread out of the D-ring and the D-ring will be pulled away from the vest leaving only the D-ring attached to the loose end of the rope. Previous release of the D-ring from the vest is prevented by the secure fastening of the safety belt by the cam-type buckle.

Another feature of the present invention is a square support patch secured to a strip on the front of the vest. The support patch includes two pairs of parallel extending slots forming a square configuration on the patch. Guides and rescuing personnel use the patch to attach knives to their vest or other equipment which needs to be secured to the vest and rapidly accessible for use or in an emergency situation.

It is therefore an object of the present invention to provide a life vest having a safety belt harness system which includes a releasably mounted D-ring on the vest through which a safety belt is threaded for rapid release of the safety belt and an almost contemporaneous release of the D-ring.

It is another object of the present invention to provide a life vest having a safety belt encircling the vest and which is secured at the front of the vest by a cam-type buckle with a releasably mounted D-ring secured to the rear of the vest with a safety belt passing through the D-ring so that upon exertion of a force on the D-ring, by a rope, the life vest will remain secured to the rope and upon opening of the buckle, the D-ring will be pulled away from the vest as the free end of the safety belt passes through the D-ring.

It is yet another object of the present invention to provide a life vest having a safety belt harness system which includes a releasably mounted D-ring on the vest through which a safety belt is threaded for rapid release of the safety belt and an almost contemporaneous release of the D-ring, with a slotted support patch on the front of the vest for receipt of materials readily accessible to the wearer.

It is still another object of the present invention to provide a life vest having a safety belt encircling the vest which is secured at the front of the vest by a cam-type buckle with a releasably mounted D-ring secured to the rear of the vest with a safety belt passing through the D-ring so that upon exertion of a force on the D-ring, by a rope, the life vest will remain secured to the rope and upon opening of the buckle, the D-ring will be pulled away from the vest as the free end of the safety belt passes through the D-ring and the vest includes a support patch having a plurality of slots for storing materials to be readily accessible to the wearer.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
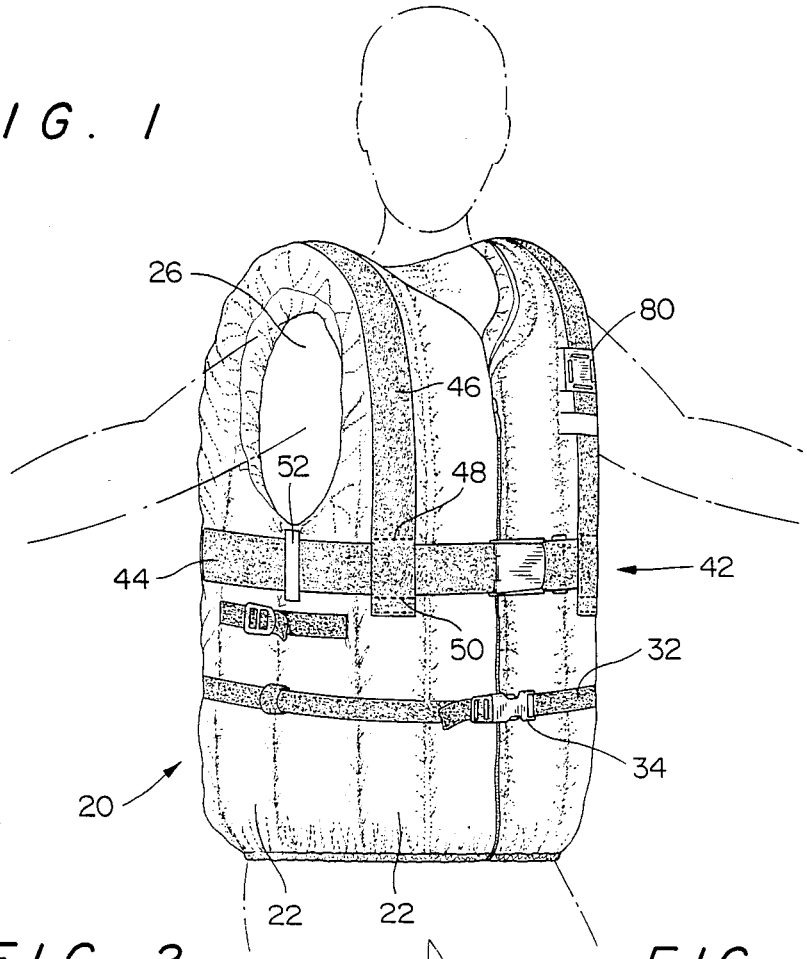
FIG. 1 is a perspective view of the safety belt harness system and implement storing patch of the invention mounted on a life vest.
Figure 2:
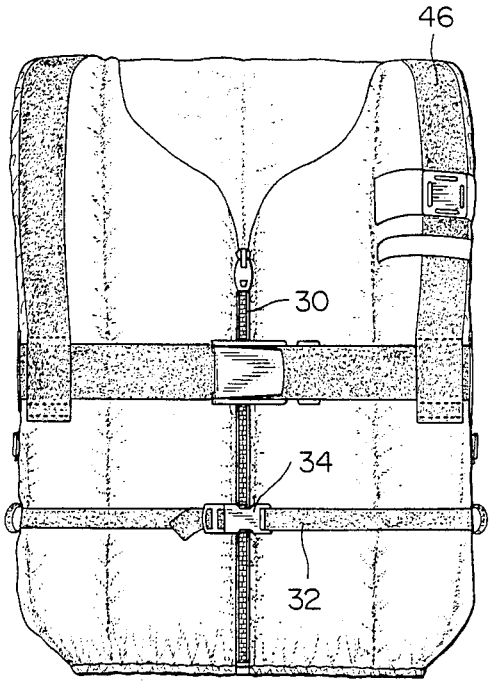
FIG. 2 is a front view of the life vest.
Figure 3:
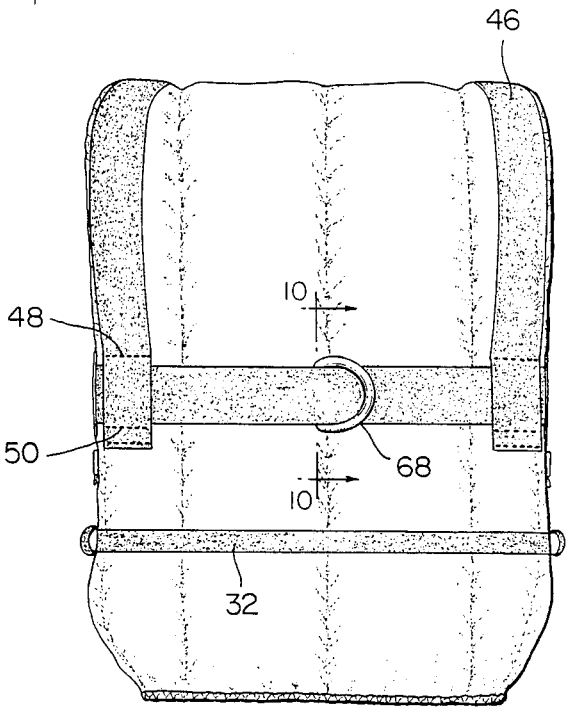
FIG. 3 is a rear view of the life vest.
Figure 4:
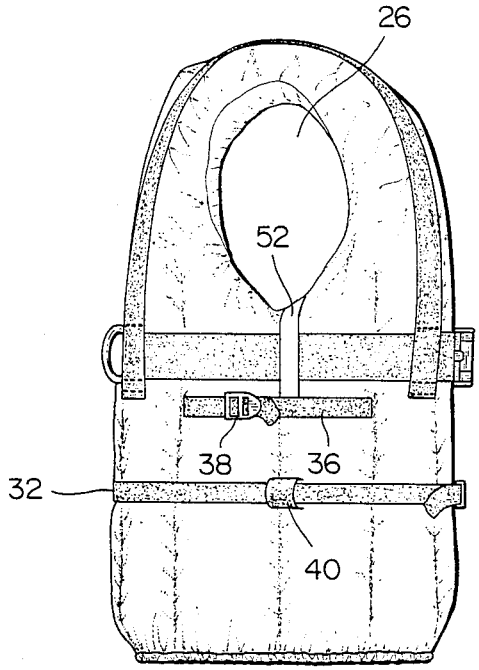
FIG. 4 is a right side view of the life vest.
Figure 5:
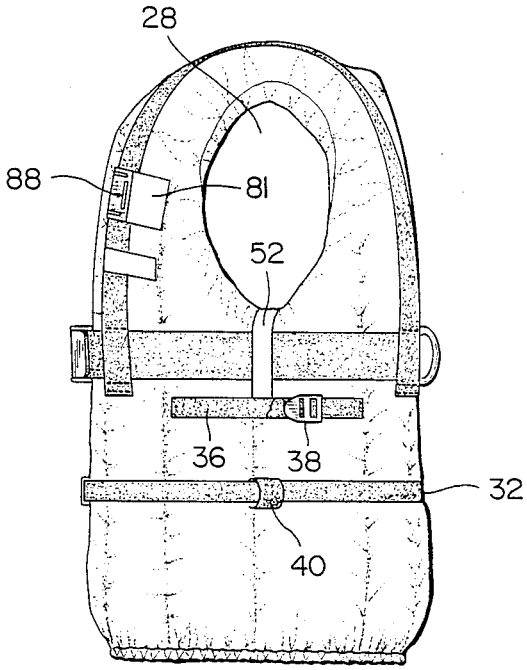
FIG. 5 is a left side view of the life vest.
Figure 6:
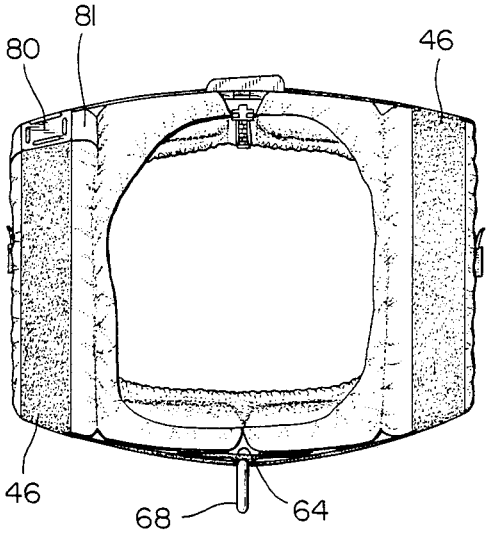
FIG. 6 is a top view of the life vest.
Figure 7:
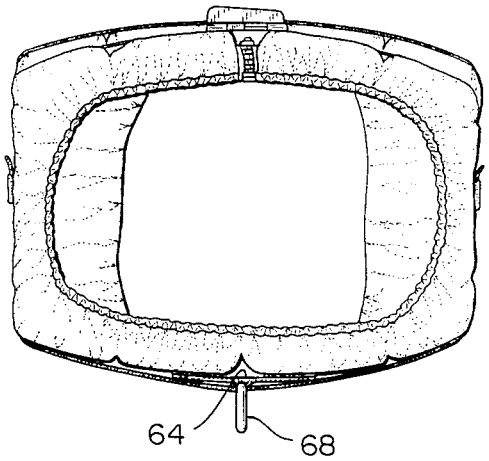
FIG. 7 is a bottom view of the life vest.
Figure 8:
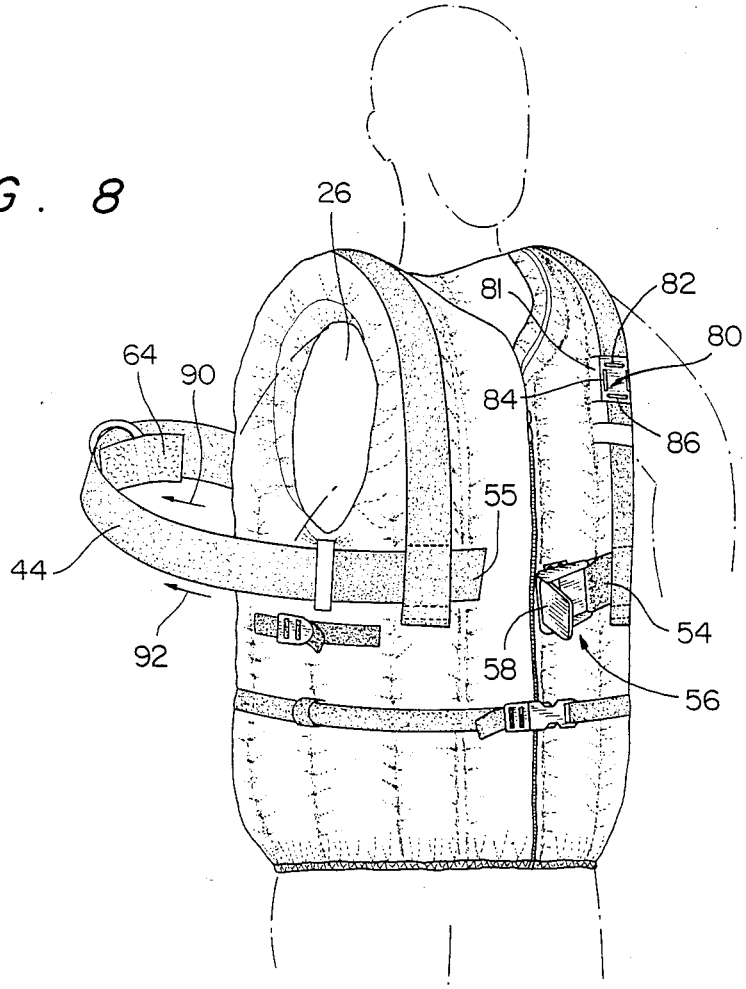
FIG. 8 is a perspective view of the safety belt harness system of the invention with the safety belt in an unlocked position so that the free end of the safety belt may be unthreaded from a D-ring.
Figure 9:
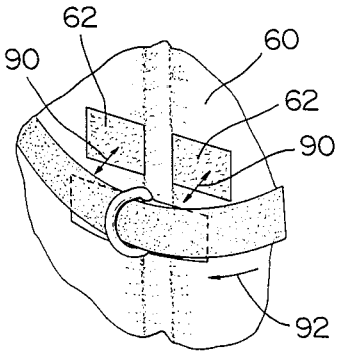
FIG. 9 is a partial view of the rear of the vest as the D-ring is released from a VELCRO-type attachment.
Figure 10:
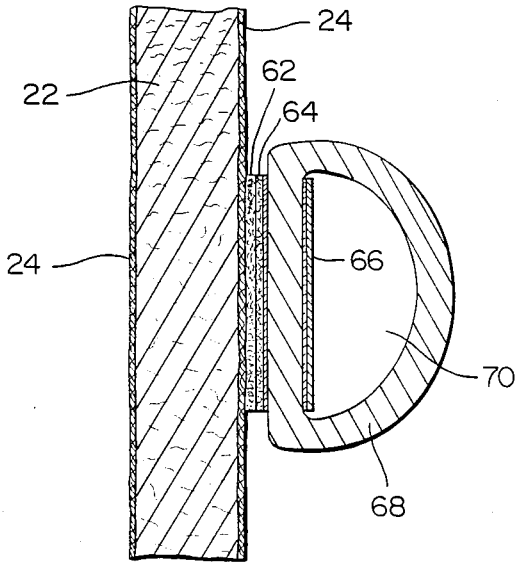
FIG. 10 is a sectional view taken along 10—10 of FIG. 3.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 8, in particular, a life vest having a safety belt harness system and an implement holding support patch embodying the teaching of the subject invention is generally designated as 20. It is intended that the term life vest include life jackets, life preservers, personal flotation devices (PFD), whether U.S. Coast Guard approved and Underwriter's Laboratories listed, or not. The life vest includes a plurality of vertically extending floatation cells 22 which are encased in a fabric casing 24. The vest 20 includes arm holes 26 and 28.

The vest is loosely secured around the upper torso of the wearer by a zipper assembly 30. When zippered, the vest will loosely fit on the wearer. To tighten the vest on the wearer, a securing strap 32 having a securing buckle 34 is tightened. Alternately, a "waist tie" without a buckle may be used. Usually, the securing strap has hardware on both ends of the strap. In addition, side securing straps 36 having sliding buckles 38, are located on opposite sides of the vest. The buckle 34 of the securing strap 32 will usually be locked whenever the vest is to be worn so as to ensure that the vest is secured about the body of the wearer. Loops 40 on opposite sides of the vest are also provided for threading of the securing strap 32 about the vest.

The safety belt harness system is generally designated as 42. The harness system includes a two-inch wide webbed safety belt 44 which extends about the vest. The safety belt passes between shoulder straps 46 and the vest at four locations, two on the front of the vest and two on the rear of the vest. The shoulder straps 46 are stitched to the vest except between stitch lines 48, located above the safety belt as shown in FIG. 1, and stitch lines 50, located below the safety belt as shown in FIG. 1, at each of four locations to form pockets through which the safety belt passes under the shoulder straps. In addition, the safety belt 44 passes through two vest loops 52 located on opposite sides of the vest for guiding the safety belt 44 around the vest.

One end 54 of safety belt 44 is fixed up to cam-type buckle 56 which is available under the tradename FIX-LOCK® from Fixfabriken, Goteborg, Sweden. The other end 55 or free end of the safety belt 44 is threaded into the buckle 56, after which pivot plate 58, which includes a cammed end, is rotated to engage and press the threaded portion of the safety belt, which is spaced from the free end 55, within the buckle 56 to securely lock the safety belt within the buckle. Alternately, any other type of securing buckle may be used as long as the free end of the belt which enters the buckle has no buckle hardware attached to it, so that the free end of the belt is able to slip out freely from the buckle when the buckle is opened.

At the rear 60 of the vest 20 are two patches 62 which form a portion of a VELCRO® hook and catch fastener. The mating portion of the VELCRO® hook and catch fastener is formed by a strip 64. Secured to strip 64 is a strip 66, between which is secured a metal annular D-ring 68 by extensive stitching between the strips 62 and 64. Alternately, an O-ring or strong webbing may be used. The D-ring fixed between strips 62 and 64 is normally releasably mounted on the rear 60 of the vest by engagement with the patches 62.

The safety belt 44 is normally worn on the life vest by passing the free end 55 of the belt under the left front shoulder strap 46, the left side loop 52, under the left rear shoulder strap 46, through the opening 70 defined by the D-ring 68, under the right rear shoulder strap 46, through the right side loop 52, and under the right front shoulder strap 46. The free end 55 is then passed through the buckle 56 and secured in place by the cam mechanism of the pivot plate 58 of the buckle.

In use, the vest 20 will be worn with the safety belt threaded around the vest, including through the opening of the D-ring and secured in the front of the vest by the buckle 56. In the event that a rescuer of someone in danger needs to wear a life vest for descending from a helicopter or swimming to save someone caught in rapids, for example, a hook from a rope will be secured to the D-ring 68 by passing through the opening 70. The rescuer would then maneuver towards the person to be saved while being securely attached by the rope to the helicopter or a point on shore to which the other end of the rope had been secured.

In the event the rescuer wearing the vest becomes endangered or needs to perform a maneuver for rescuing someone which is hampered by the connection of the rope to their vest, the pivot plate 58 of the buckle 56 is opened. During a rescue operation, upon release of the buckle 56, the safety belt would automatically be removed from the vest by the tension on the connecting or securing rope line and immediately free the rescuer to accomplish their goal.

Due to the tensioning of the rope connected to the D-ring 68, the D-ring will, by the force from the rope, detach from the rear of the vest in the direction of arrows 90 by overcoming the resistance of the securing VELCRO® hook and catch fasteners 62, 64. The safety belt would then be rapidly removed in the direction of arrows 92 from out of the buckle 56, under the right front shoulder strap, the right side loop and then ultimately from the opening 70 of the D-ring 68. The rope secured to a fixed object would then only be attached to the D-ring and its securing strips 64 and 66 with the rescuer being free to maneuver without being secured by a rope to a fixed object.

As an aid in a rescue attempt or for everyday storage of items which need to be quickly available and accessible, a support patch 80 is secured to the vest 20. In the example shown, the patch 80 is secured to a strip 81 which extends transversely to the left front shoulder strap and passes over the left front shoulder strap. The patch 80 may also be secured directly to the fabric of the vest.

The patch 80 includes four longitudinally extending slots 82, 84, 86 and 88. Slots 82 and 86 extend parallel to each other and perpendicular to slots 84 and 88. Only the peripheral edges of the patch 80 are secured to the strip 81 and therefore, an item to be secured to the vest may be passed through any one of the slots so as to pass through an opposite, parallel extending slot, for example slots 82 and 86, so as to be held in frictional engagement between the patch and the strip 81 so as to be readily accessible by the wearer.

Alternately, the patch 80 may include only two parallel extending slots. Also, the patch may be round with two slots, or rectangular with two or four slots.

Having described the invention, many modifications thereto will become apparent to those skilled in the art to which it pertains without deviation from the spirit of the invention as defined by the scope of the appended claims.

I claim:

1. A flotation device comprising:

a life vest, securing means mounted on said life vest for securing said life vest about the body of a wearer, and a safety belt harness system mounted on said life vest and said safety belt harness system including connection means for removably securing a life line to said life vest so that the life line may be rapidly released from said life vest, said safety belt harness system including a safety belt surrounding said life vest and said belt including a rapid release buckle, said safety belt extending through said connection means so that said connection means is held on said life vest by said safety belt and said connection means is removed from said life vest with the life line by a force from the life line when said buckle is opened, said connection means including a ring and mounting means for removably securing said ring to said life vest.

2. A flotation device according to claim 1, wherein said buckle is a cam-type buckle.

3. A flotation device according to claim 1, wherein a free end of said belt is threaded through said ring and the life line is secured to said ring and thereby connected to said life vest when said buckle is locked.

4. A safety belt harness system comprising:

a life vest for buoyantly supporting a wearer in water, securing means for securing said life vest to the wearer, belt loops spaced about said life vest, a safety belt threaded through said loops, a buckle secured at one end of said safety belt for locking said safety belt on said life vest, a ring member, mounting means for removably mounting said ring member to said life vest, a free end of said safety belt being threaded through said ring member in advance of being threaded through said buckle for locking of said buckle so that when a force is exerted by a life line secured to said ring member and said buckle is opened, at least part of said mounting means becomes rapidly detached from said life vest with said ring member and said free end of said safety-belt is withdrawn from said ring member.

5. A safety belt harness system according to claim 4, wherein said buckle is a cam-type buckle.

6. A safety belt harness system according to claim 4, wherein said mounting means includes two strips with said ring member secured therebetween.

7. A safety belt harness system according to claim 5, wherein one of said two strips engages with a patch secured to said vest to releasably mount said ring member on said life vest.

8. A safety belt harness system according to claim 7, wherein said patch is located on a rear side of said life vest.

9. A safety belt harness system according to claim 4, wherein said life vest includes a support patch having a plurality of openings spaced about said support patch.

10. A safety belt harness system according to claim 9, wherein said plurality of openings are elongated slots.

11. A safety belt harness system according to claim 10, wherein said elongated slots include two pairs of parallel extending slots, with each pair extending perpendicular to the other.

12. A safety belt harness system according to claim 10, wherein said plurality of openings are spaced about a periphery of said support patch.

* * * * *